United States Patent [19]

Horner

[11] Patent Number: 4,905,455

[45] Date of Patent: Mar. 6, 1990

[54] STRETCH WRAPPING

[75] Inventor: David W. Horner, Bristol, United Kingdom

[73] Assignee: DRG (UK) Limited, Bristol, United Kingdom

[21] Appl. No.: 199,660

[22] Filed: May 27, 1988

[51] Int. Cl.[4] ..... B65B 53/00

[52] U.S. Cl. ..... 53/441; 53/556; 53/588; 226/193

[58] Field of Search ..... 53/210, 399, 556, 587, 53/588, 441; 226/190, 193

[56] References Cited

U.S. PATENT DOCUMENTS 2,660,380 11/1953 Blackman et al. ..... 226/193

3,534,893 10/1970 Maxson ..... 226/193

4,429,514 2/1984 Lancaster et al. ..... 53/588

FOREIGN PATENT DOCUMENTS 271256 6/1988 European Pat. Off. ..... 53/556

*Primary Examiner*—W. Donald Bray

*Attorney, Agent, or Firm*—Larson and Taylor

[57] ABSTRACT

Stretch wrapping apparatus that uses two rollers 17,18 rotating at different speeds to stretch a web or wrapping material has problems of slippage when applied to wrapping grass. These are ameliorated by forming the roller surfaces with projections 32, e.g. by applying a mesh or (better) forming axial corrugations. The surfaces are preferably of metal, particularly aluminum.

11 Claims, 2 Drawing Sheets

STRETCH WRAPPING

BACKGROUND OF THE PRESENT INVENTION

The present invention relates to an apparatus and method for the wrapping of an object by enclosing it in a film of stretched material, normally plastics material. It is particularly concerned with wrapping bales of grass.

Stretch wrapping is well-known, and various wrapping apparatuses have been devised to carry it out. For example in GB No. 2063809 a stretch wrapping apparatus is disclosed in which web material is passed over two rollers rotating at different speeds, so that the web is stretched between the rollers, and then wrapped around an object. (U.S. Pat. Nos. 4,302,920, 4,336,679, 4,387,548 and 4,429,514 correspond, and their disclosures are incorporated herein by reference.)

FIG. 1*a* of the accompanying drawings shows the stretch wrapping apparatus 10 of GB No. 2063809. This has a horizontal frame 11 on which an object 12 to be wrapped is mounted via a rotatable turntable 13, and a vertical frame 14 on which is mounted the device for stretching the film. A roll 15 of film to be stretched is mounted on a mandrel rotatable about an axis 16, and the film web is drawn from that mandrel round a first roller 17 and a second roller 18 spaced apart by a distance 19. From the roller 18, the web 20 extends to the object 12 (optionally via an idle roller 21). The turntable 13 rotates the object 12 so that the web 20 is drawn from the roll 15 to the object 12, via the rollers 17, 18. These are arranged to rotate at different speeds, the roller 18 travelling faster than the roller 17, so that the web 20 is stretched as it passes over the distance 19.

In normal use, the optimum relationship between the speeds of rotation of the rollers 17 and 18, which determines the elongation of the stretched web, is determined by the type of material being stretched. Typical materials are polyethylene, and in particular Linear Low Density Polyethylene (LLDPE) which has improved stretch characteristics relative to normal polyethylene, or PVC.

In normal industrial settings, the apparatus of GB No. 2063809 discussed above with reference to FIG. 1 has proved satisfactory. However, the applicants have considered the wrapping of cut grass in this way and have discovered problems.

It is now becoming common for grass for silage to be cut and then rolled into cylindrical bales which are then stored. To protect the bales, it is known to wrap them in plastic, and it has been perceived that stretch wrapping techniques would be applicable. However, it has been found that slippage of the film occurs at the rollers, so that parts of the web are not stretched fully. This has the disadvantage of requiring more material than necessary to wrap a given bale, and also causes the problem that when the plastics material shrinks, as it does to a limited extent due to recovery of shape, the shrinkage will be uneven around the bale. The reason for the slippage is not fully understood. It is thought, however, that grass debris collects on the surfaces of the rollers, effectively lubricating the surfaces.

In GB No. 2063809 it had been proposed that the rollers were rubber faced, as it was thought that maximum film contact was preferred.

SUMMARY OF THE INVENTION

It is an object of the invention to overcome or ameliorate the problem of slippage discussed above. The present inventor has found that this can be achieved if the surfaces of the roller are provided with projections, in particular substantially incompressible projections. It has been found that if this is done the problem of slippage is eliminated, or at least reduced.

Thus in one aspect the invention provides web feed control means for wrapping apparatus comprising support means defining a web supply path; two rollers mounted to said support means so as to be spaced apart along said web supply path; relative speed control means couplable to said rollers and adapted to cause said rollers to rotate at different peripheral speeds in use, such that web passing them is stretched; said rollers having web contacting surfaces which are provided with projections.

The apparatus may be provided as a web feed control unit which provides the rollers, appropriately mounted, and coupled via the means for controlling their relative rotational speeds. This can be coupled by the purchaser to the object handling apparatus, e.g. comprising means for rotating an object to effect wrapping. This may comprise a turntable assembly as shown in FIG. 1. For all-around wrapping, rotation about two axes may be required. For example, a bale wrapping apparatus may have a pair of spaced horizontally-extending support rollers on which the bale is supported, at least one of which is drivable to rotate the bale about a horizontally extending axis. For rotation about a vertically extending axis, the rollers may be mounted on a turntable (so that they are interposed between the object 12 and the turntable 12 shown in FIG. 1). Alternatively, the web feed assembly (comprising the web feed control unit and the web supply) may be mounted on a carrier which is movable around the object, e.g. being supported by a rotatable arm. Both types of arrangement are well known. In a second aspect the invention provides apparatus comprising the web feed control unit and the object handling apparatus, operatively linked so that operation of the object handling apparatus can cause web to be drawn through the web feed control unit which causes the rollers thereof to rotate at different speeds so as to impart stretch to the web.

In a third aspect the invention provides a method of stretch wrapping an object (particularly a bale of grass) wherein the wrapping web is stretched by passing it through a web feed control unit according to the first aspect.

Many different projection configurations are possible. One arrangement that has been tried is to provide a metal mesh on the surface of the roller, i.e. projections running in two directions, e.g. both axially and circumferentially of the roller. This has been found to work satisfactorily. However, noise develops as the rollers rotate, and therefore the preferred roller surface is formed with closely spaced corrugations running axially of the roller. The projections are preferably of metal, but this is not essential. Aluminum is particularly preferred: a tubular aluminum extrusion is easily produced with a suitable surface, and aluminum can have good non-slip properties.

DESCRIPTION OF THE PREFERRED EMBODIMENTS

Figure 1:
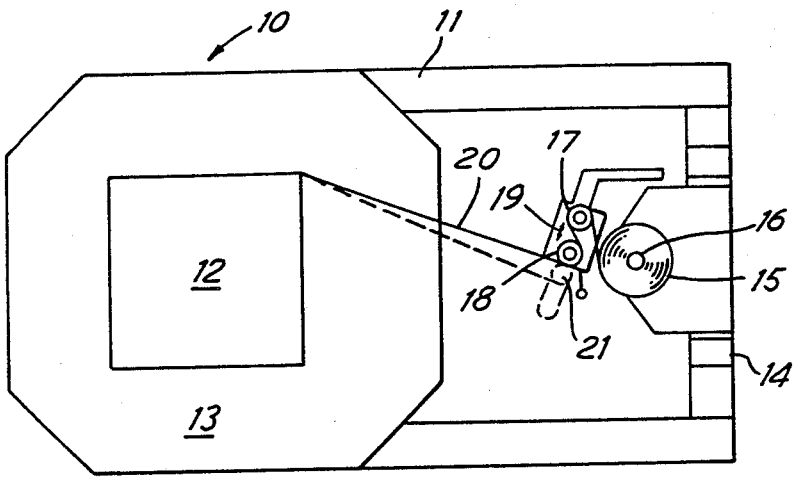
FIG. 1 PRIOR ART
FIG. 1 shows a wrapping apparatus according to GB No. 2063809, and has already been discussed.
Figure 2:
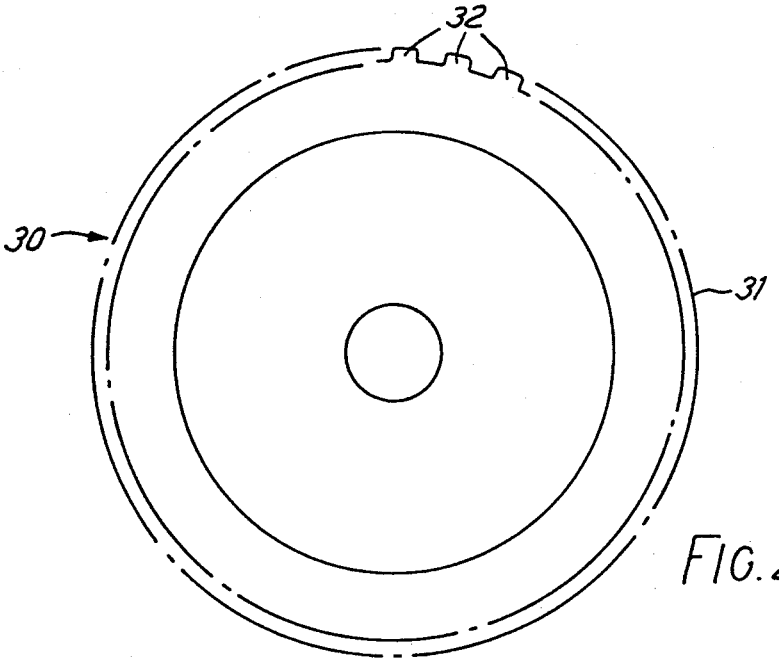
FIG. 2 shows a detail of a roller for use in the present invention.

A wrapping apparatus according to the present invention may be generally similar to that shown in FIG. 1, except that the rollers 17 and 18 are modified so that they have projections on their surfaces. The projections provide film traction. They are desirably shaped so that they do not damage or perforate the film. It is possible to provide a mesh on the surface, so that projections run both axially and circumferentially of the rollers 17,18, but preferably a roller 30 as shown in FIG. 2 is used for both the rollers 17 and 18. The surface 31 of the roller 30 which contacts the web is formed by corrugations 32 which form the projections of the present invention and run axially of the roller 30. The spacing of the corrugations 32 is not critical, but if the spacing is too wide, it causes problems with noise generation, as discussed with reference to the mesh arrangement. Also, if the spacing of the corrugations is too wide, uneven stretch of the film may occur due to the different reaction of the film to the raised and trough parts of the corrugations.

A desirable form of corrugation has crests which are substantially flat or circumferentially extending, rather than being formed as teeth.

Figure 3:
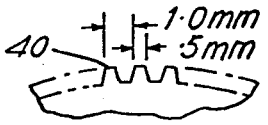
FIG. 3 shows a detail of an alternative roller.

We have successfully used corrugations as shown in FIG. 2 with a repeat length (or pitch) of 3 or even 5 mm (on rolls of diameter 63 mm or other sizes). However, when we use black pigmented film, a visible bar marking pattern may be produced. This does not seriously affect the ability to wrap. But it does suggest that there are regions of high and low stretch. Furthermore, light bands may be undesirable if the film wrapping is intended to exclude light. We have found that such banding can be prevented by using a smaller pitch—less than 2 mm, and suitably 1 mm. FIG. 3 shows a suitable form of corrugations: each projection has a flat land 40 of width 0.5 mm, and the height is also 0.5 mm. The sides are angled, so that there is virtually no spacing between the bases of adjacent projections. This form of projection is simple to manufacture. Not only do rollers with such projections avoid banding, but the production of noise is also less.

A roller 30 may comprise an aluminum extrusion whose outer surface provides the projections.

Figure 4:
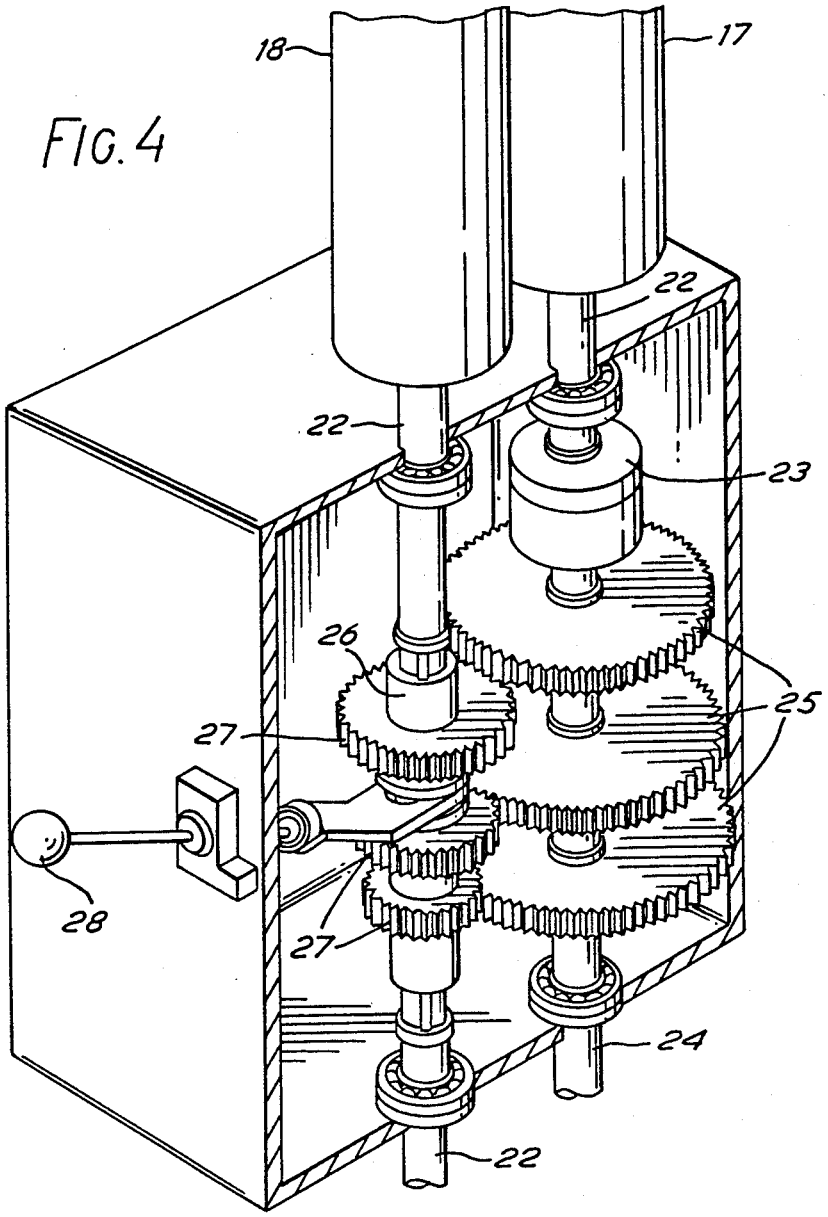
FIG. 4 shows a means for controlling roller relative speeds.

GB No. 2063809 discloses various means for causing the rollers 17,18 to rotate in opposite senses at different rates. Our preferred means is shown in FIG. 4 (based on FIG. 1 of said patent). The rollers 17,18 are fast with respective shafts 22 connected to a gear assembly. The shaft 22 of the first roller 17 is couplable via a clutch assembly 23 to a shaft portion 24 bearing three gear wheels 25 of different sizes. A sleeve 26 bearing three gear wheels 27 of different, smaller sizes is mounted on the shaft 22 of the second roller 10 so as to be axially slidable but rotationally fast (e.g. being splined). A lever arrangement 28 controls its sliding so that a desired gear 27 on the sleeve can be meshed with a corresponding gear on the shaft portion 24. Thus when the clutch assembly 23 is engaged, rotation of the second roller 18 at a first rate causes the first roller 17 to rotate at a predetermined lower rate. A web feed control unit embodying the invention may be a unit generally as shown in FIG. 4, modified in accordance with FIG. 2 or FIG. 3. Of course, for some purposes variation in stretch rate may not be necessary. The rollers 17,18 could then be coupled together with a fixed gear ratio.

By providing a stretch wrapping apparatus in which the rollers between which the wrapping material is stretched have projections on their surfaces, it has been found possible to wrap grass as discussed above without slippage occurring. However, the present invention is also applicable to wrapping of other objects.

I claim:

1. Web feed control means for wrapping apparatus comprising support means defining a web supply path; two rollers mounted to said support means so as to be spaced apart along said web supply path, relative speed control means couplable to said rollers and adapted to cause said rollers to rotate at different peripheral speeds in use, such that web passing them is stretched; said rollers having web contacting surfaces which are provided with projections.

2. Web feed control means according to claim 1 wherein the projections of at least one said roller are provided by corrugations running parallel to its axis.

3. Web feed control means according to claim 2 wherein the corrugation has crests which are substantially flat or circumferentially extending.

4. Web feed control means according to claim 2 wherein the corrugations have a pitch of less than 2 mm.

5. Web feed control means according to claim 1 wherein at least one of said web contacting surfaces comprises means defining a mesh.

6. Web feed control means according to claim 1 wherein the projections are substantially incompressible in use.

7. Apparatus according to claim 6 wherein the projections are of metal.

8. Apparatus according to claim 7 wherein said roller comprises a tubular aluminum extension with axially extending ribs which constitute said projections.

9. Stretch wrapping apparatus comprising a carrier for an object to be wrapped, a web supply station, means defining a web supply path extending from said supply station to an object when carried by said carrier, means for displacing the circumference of a carried object relative to the supply station to effect wrapping; and web feed control means comprising support means, two rollers mounted to said support means so as to be spaced apart along said web supply path; relative speed control means couplable to said rollers and adapted to cause said rollers to rotate at different peripheral speeds in use, such that web passing them is stretched; said rollers having web contacting surfaces which are provided with projections.

10. A method of stretch wrapping an object comprising feeding wrapping web material around said object from a web supply station via two rollers which are spaced apart along the web path and causing the downstream roller to rotate with a greater peripheral speed whereby the web material is stretched between the rollers; and wherein said rollers having web contacting surfaces which are provided with projections.

11. A method of stretch wrapping a bale of grass comprising feeding wrapping web material around said bale from a web supply station via two rollers which are spaced apart along the web path and causing the downstream roller to rotate with a greater peripheral speed whereby the web material is stretched between the rollers; and wherein said rollers having web contacting surfaces which are provided with projections.

* * * * *